US008430504B2

(12) United States Patent
Maekawa

(10) Patent No.: US 8,430,504 B2
(45) **Date of Patent: *Apr. 30, 2013**

(54) PRINTER OPENING AND CLOSING MECHANISM WHICH PREVENTS INTERFERENCE OF THE PLATEN AND THE INKJET HEAD

(75) Inventor: Hironori Maekawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/464,223

(22) Filed: May 4, 2012

(65) Prior Publication Data

US 2012/0218354 A1 Aug. 30, 2012

Related U.S. Application Data

(63) Continuation of application No. 12/288,049, filed on Oct. 15, 2008, now Pat. No. 8,197,060.

(30) Foreign Application Priority Data

Oct. 15, 2007 (JP) ..... 2007-267488

(51) Int. Cl.
*B41J 2/01* (2006.01)

(52) U.S. Cl.
USPC ..... 347/104; 347/108

(58) Field of Classification Search ..... 347/104, 347/108
See application file for complete search history.

(56) References Cited

U.S. PATENT DOCUMENTS

| | | | |
|---|---|---|---|
| 5,238,317 | A | 8/1993 | Bohmer et al. |
| 5,393,152 | A | 2/1995 | Hattori et al. |
| 5,791,796 | A | 8/1998 | Gustavsson et al. |
| 5,887,999 | A | 3/1999 | Smith et al. |
| 6,102,590 | A | 8/2000 | Harris et al. |
| 6,118,469 | A | 9/2000 | Hosomi |
| 6,155,730 | A | 12/2000 | Nakayama et al. |
| 6,336,760 | B2 | 1/2002 | Mori et al. |
| 6,345,782 | B1 | 2/2002 | Nakayama et al. |
| 6,361,231 | B1 | 3/2002 | Sato et al. |
| 6,406,200 | B2 | 6/2002 | Mahoney |
| 6,474,883 | B1 | 11/2002 | Kawakami et al. |

(Continued)

FOREIGN PATENT DOCUMENTS

| | | | |
|---|---|---|---|
| CN | 1393343 | A | 1/2003 |
| JP | 2000-103549 | A | 4/2000 |

(Continued)

OTHER PUBLICATIONS

English Abstract of JP2004-74812.

(Continued)

*Primary Examiner* — Julian Huffman
*Assistant Examiner* — Sharon A Polk
(74) *Attorney, Agent, or Firm* — Nutter McClennen & Fish LLP; John J. Penny, Jr.; Christian M. Sperry

(57) ABSTRACT

A roll paper printer enables opening the cover and platen using a 4-part parallel linkage mechanism without interfering with the inkjet head. The cover unit for the roll paper compartment of the roll paper printer opens and closes by means of the parallel linkage mechanism. The back end part of the platen frame part of this linkage mechanism is connected to the top end part of the rear parallel links and so that the platen frame can move down.

5 Claims, 7 Drawing Sheets

U.S. PATENT DOCUMENTS

| | | | |
|---|---|---|---|
| 6,629,796 | B2 | 10/2003 | Kawakami et al. |
| 6,758,614 | B2 | 7/2004 | Yamada et al. |
| 6,789,969 | B2 | 9/2004 | Hirabayashi et al. |
| 6,793,419 | B2 | 9/2004 | Nebashi |
| 6,997,623 | B2 | 2/2006 | Nebashi |
| 7,780,367 | B2 | 8/2010 | Yoshioka |
| 7,823,490 | B2 | 11/2010 | Evans et al. |
| 2005/0232679 | A1 | 10/2005 | Na et al. |
| 2009/0096854 | A1 | 4/2009 | Maekawa |

FOREIGN PATENT DOCUMENTS

| | | | |
|---|---|---|---|
| JP | 2000-108430 | A | 4/2000 |
| JP | 2001-158141 | A | 6/2001 |
| JP | 2001-158142 | A | 6/2001 |
| JP | 2003-001884 | A | 1/2003 |
| JP | 2003-001885 | A | 1/2003 |
| JP | 2003-276255 | A | 9/2003 |
| JP | 2004-74812 | | 3/2004 |
| JP | 2007-203563 | A | 8/2007 |
| JP | 2007-203564 | A | 8/2007 |

OTHER PUBLICATIONS

Office Action dated Mar. 29, 2011 in U.S. Appl. No. 12/288,049.
Office Action dated Sep. 7, 2011 in U.S. Appl. No. 12/288,049.
Advisory Action dated Dec. 19, 2011 in U.S. Appl. No. 12/288,049.
Notice of Allowance dated Jan. 31, 2012 in U.S. Appl. No. 12/288,049.

PRINTER OPENING AND CLOSING MECHANISM WHICH PREVENTS INTERFERENCE OF THE PLATEN AND THE INKJET HEAD

The entire disclosure of U.S. patent application Ser. No. 12/288,049 filed on Oct. 15, 2008, is expressly incorporated by reference herein. The entire disclosure of Japanese Patent Application No. 2007-267488 filed on Oct. 15, 2007, is expressly incorporated by reference herein.

BACKGROUND OF THE INVENTION

1. Field of Invention

The present invention relates to a printer that has an opening/closing mechanism that opens while a platen disposed opposite a print head separates from the print head when the cover opens.

2. Description of Related Art

With roll paper printers used to issue receipts, for example, a length of printing paper pulled off the roll must be threaded through the paper transportation path between the print head and platen and between the paper feed roller and pressure roller to the paper exit. In order to simplify loading the roll paper, roll paper printers having an opening/closing mechanism that causes the platen disposed opposite the print head to open in conjunction with the cover so that the paper transportation path also opens when the cover of the roll paper compartment is opened are known from the literature. One type of known opening/closing mechanism is a four-part parallel linkage mechanism that opens away from the print head with the platen held positioned opposite the print head. Japanese Unexamined Patent Appl. Pubs. JP-A-2007-203563 and JP-A-2007-203564 teach a roll paper printer that uses a four-part parallel linkage mechanism to open and close the cover and platen.

When a 4-part parallel linkage mechanism is used, the platen frame on which the platen is disposed opens and closes with the cover while remaining in the same posture. As a result, when there are parts that protrude past the platen toward the print head, such as when gears, bearings, and a paper guide are supported on the platen frame, these protruding parts may interfere with the print head. In an inkjet roll paper printer, for example, the platen opposes the nozzle surface of the inkjet head with a predetermined gap therebetween. Therefore, if components that protrude beyond the platen toward the print head are mounted on the platen frame, these protruding parts may touch and damage the nozzle surface when the cover opens and closes.

A problem with a conventional opening/closing mechanism that uses a 4-part parallel linkage mechanism is that parts protruding beyond the platen toward the print head cannot be disposed to the platen frame to open and close together with the cover and the platen.

If such protruding parts are used in a serial inkjet roll paper printer, the cover must be opened and closed after confirming that the inkjet head has retracted to a retracted position removed from the printing area. In addition, when the inkjet head is in the printing area, the cover must be locked so that the cover cannot be accidentally opened and the protruding parts will not hit the nozzle surface of the inkjet head.

SUMMARY OF THE INVENTION

A printer according to the present invention enables opening and closing the cover and platen using a 4-part parallel linkage mechanism without protruding members disposed to the platen frame interfering with the print head.

A printer according to a first aspect of the invention has a print head mounted on the printer frame, a platen that is disposed to a printing position opposite the print head when printing, a linkage mechanism having a front link and a back link, a cover that opens and closes and is attached to the front link, a platen frame that connects the front link and the back link and supports the platen, and a positioning member that contacts the platen frame. The platen frame is connected to the back link so that the platen frame can move a predetermined distance, and when the cover closes to the printer frame, the platen frame moves in contact with the positioning member and is positioned to the printing position.

In a printer according to a preferred aspect of the invention, a platen frame rendering a 4-part parallel linkage mechanism is connected to a distal end part of the back link so that the platen frame can move a predetermined amount. When the cover is closed, the platen frame contacts the positioning member and is positioned to the printing position controlling the distance between the platen and the print head. When the cover opens, the positioning member and platen separate, the platen frame moves in the direction away from the print head relative to the distal end of the back link and then opens with the cover.

Therefore, if there are protruding members on the platen frame that protrude beyond the platen toward the print head, interference between the protruding members and members on the print head side is avoided because the platen frame moves a distance that avoids contact between the protruding members and the print head side when the cover opens.

Preferably, the platen frame and the distal end part of the back link are connected by an elongated hole formed in either the platen frame or the back link, and a link pin that is formed to the other of the paper feed and back link and is inserted movably in the elongated hole.

Further preferably, the positioning member is an inclined shoulder formed on the printer frame, and a positioning boss is disposed to the platen frame at a position opposing the inclined shoulder. When the cover is closed, the positioning boss moves onto and along the inclined shoulder and is positioned to the printing position as the platen frame approaches the print head.

When the cover can open and close between a closed position where the cover is substantially vertical and an open position where the cover is tilted forward to a substantially horizontal position, the platen frame is supported substantially horizontally when the cover is in the closed position, and switches to an inclined position where the back end has moved down a predetermined distance when the cover opens.

Further preferably, if the printer also has a roll paper compartment that stores roll paper having a web of printing paper wound in a roll, the cover is preferably a cover for opening and closing the roll paper compartment.

Further preferably, if the print head is an inkjet head, the printing position of the platen is a position opposing the nozzle surface of the inkjet head with a predetermined gap therebetween.

Yet further preferably, contact between the platen frame and the positioning member is released when the cover is opened.

In a printer according to the present invention the back end side of the platen frame, which renders a 4-part parallel linkage mechanism for opening and closing a cover, can move a predetermined distance away from the print head when the cover opens, and engages the positioning member and is positioned when the cover closes. When the cover opens, the back end of the platen frame moves away from the print head. As a result, even if there are protruding members on the platen frame that project beyond the platen toward the print head, the cover can be opened without the protruding members interfering with the print head.

The invention therefore enables mounting protruding members that project beyond the platen toward the print head on the platen frame. The cover can therefore be opened in a serial printer without causing damage to the print head without first confirming that the print head has been moved to a retracted position outside of the printing area, and damage to the print head is prevented if the cover is accidentally opened while the print head is in the printing area.

Other objects and attainments together with a fuller understanding of the invention will become apparent and appreciated by referring to the following description and claims taken in conjunction with the accompanying drawings.

DESCRIPTION OF PREFERRED EMBODIMENTS

A roll paper printer according to a preferred embodiment of the present invention is described below with reference to the accompanying figures.

General Configuration

Figure 1:
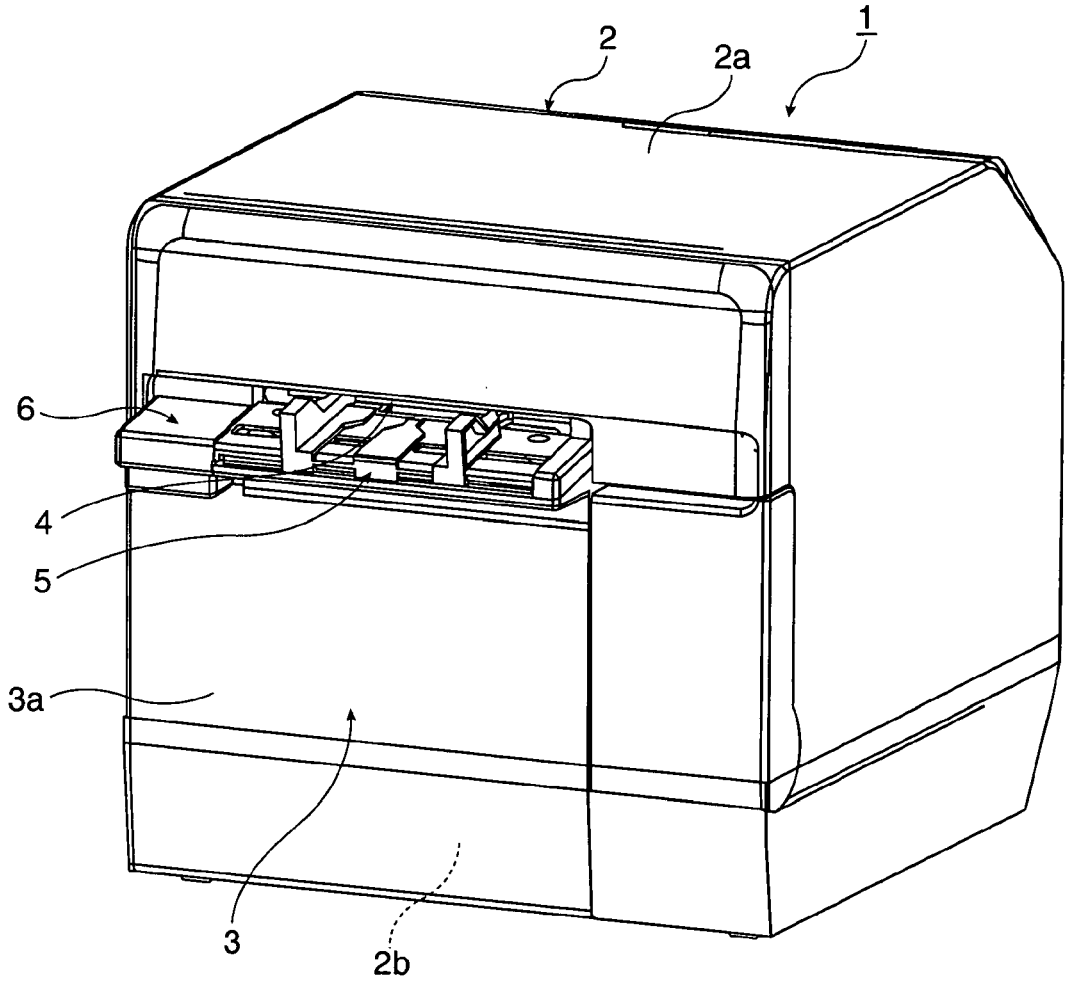
FIG. 1 is an external oblique view of a roll paper printer according to a preferred embodiment of the invention.
Figure 2:
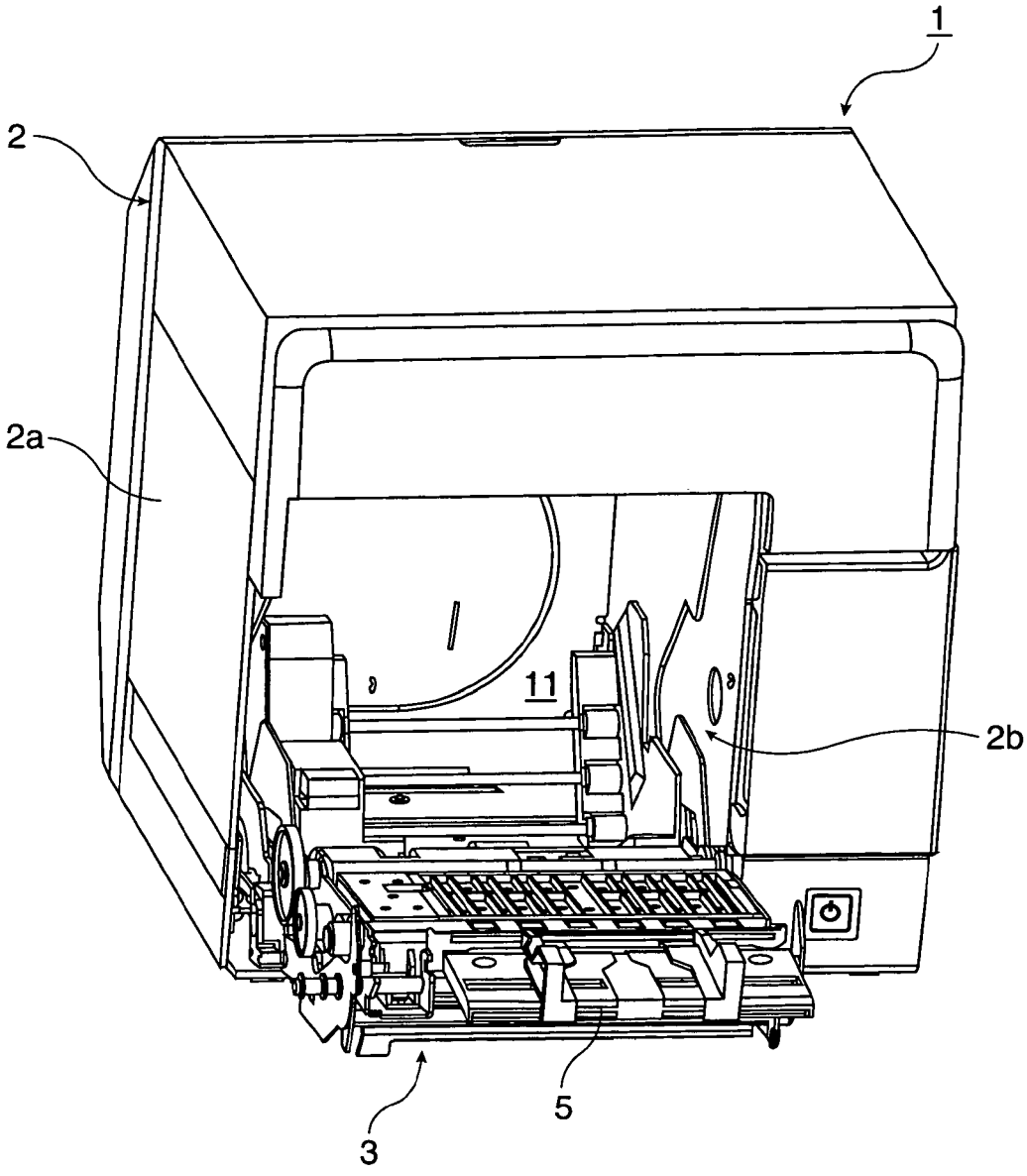
FIG. 2 is an external oblique view of the roll paper printer with the cover unit open.

FIG. 1 is an oblique view showing an inkjet roll paper printer according to a first embodiment of the invention. FIG. 2 is an oblique view of the same printer with the cover open.

The roll paper printer 1 has a rectangular box-like case 2 and a cover unit 3 that opens and closes and is disposed to the front of the case 2. The cover unit 3 includes a cover 3*a* and the opening/closing mechanism (see FIG. 3A to FIG. 7B) of the cover 3*a*. A paper exit 4 of a specific width is formed at the front of the outside case 2*a* part of the printer case 2. An exit guide 5 projects to the front from the bottom of the paper exit 4, and a cover opening lever 6 is disposed beside the exit guide 5. A rectangular opening 2*b* for loading and removing roll paper is formed in the outside case 2*a* below the exit guide 5 and cover opening lever 6, and this opening 2*b* is closed by the cover 3*a*.

Operating the cover opening lever 6 unlocks the cover unit 3. When the exit guide 5 disposed to the cover unit 3 is pulled forward after the lock is released, the cover unit 3 pivots at the bottom end part thereof and opens forward to a substantially horizontal position as shown in FIG. 2. When the cover unit 3 opens, the roll paper compartment 11 formed inside the printer is open, the paper transportation path is open from the roll paper compartment 11 to the paper exit 4, and the roll paper can be replaced from the front of the printer. Note that the cover 3*a* of the cover unit 3 and the cover opening lever 6 are not shown in FIG. 2.

Internal Configuration

Figure 3A:
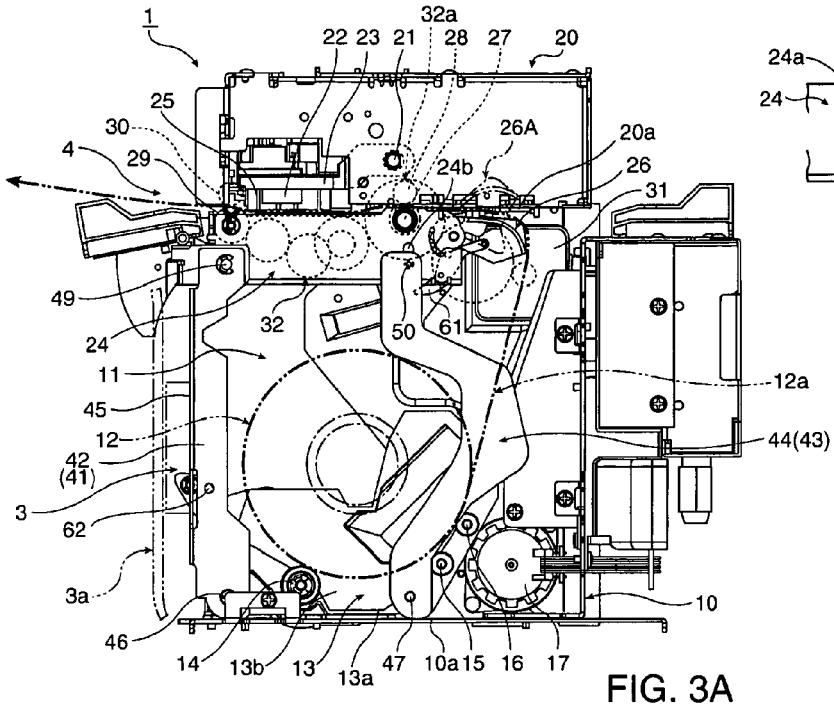
FIG. 3A is a schematic section view of the roll paper printer.
Figure 3B:
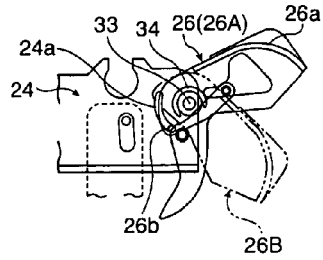
FIG. 3B describes the tension guide.
Figure 4:
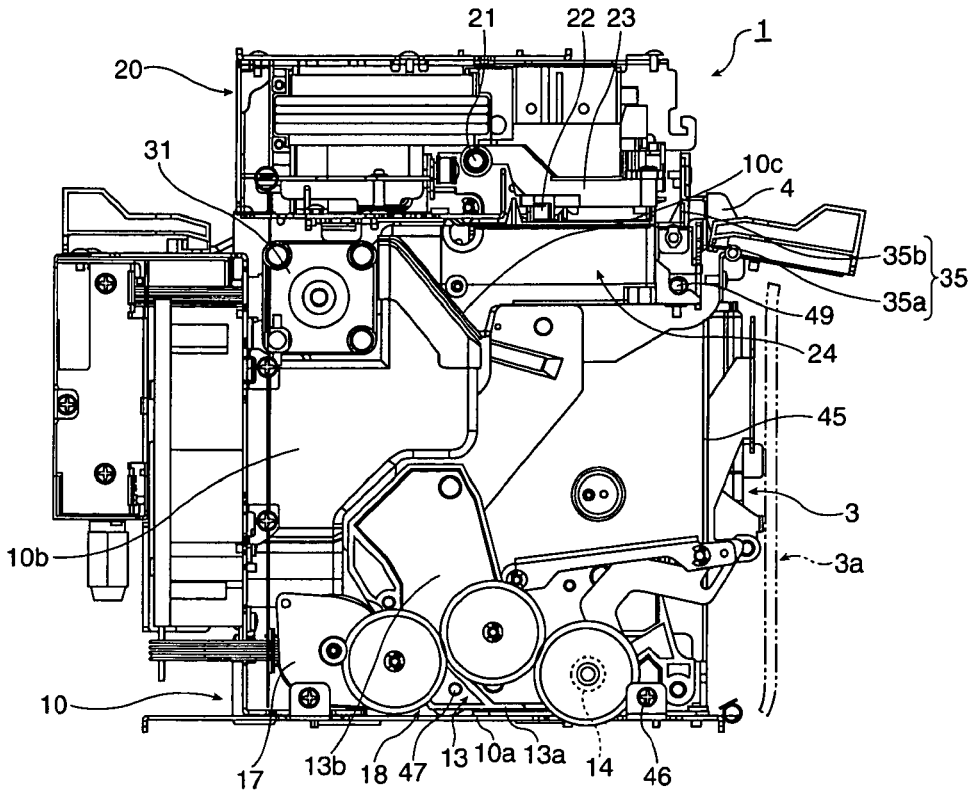
FIG. 4 is a schematic section view of the roll paper printer.

FIG. 3A is a schematic side view showing the internal configuration of the roll paper printer 1 and the opening/closing mechanism of the cover unit 3, and shows the roll paper compartment 11 from the right side of the printer. FIG. 3B describes the tension guide 26. FIG. 4 is a schematic side view showing the roll paper compartment 11 from the left side of the printer.

Referring to these figures, a roll paper compartment 11 is formed inside the roll paper printer 1 in the widthwise center of the printer frame 10. The roll paper compartment 11 has a roll holder 13 in which the roll paper 12 is stored horizontally widthwise to the printer. Note that the dimension from side-to-side of the printer across the width is referred to herein as the lateral dimension, and the dimension from front-to-back is referred to herein as the longitudinal dimension.

The roll holder 13 has a curved bottom 13*a* with the deepest part of the curve in the middle of the longitudinal dimension, and sidewalls 13*b* formed on the lateral ends of the bottom 13*a*. A delivery roller 14 that extends laterally to the printer is disposed to the curved bottom part at the front of the bottom 13*a*. Two guide rollers 15 and 16 are disposed to rotate freely at the back side of the curved bottom part of the bottom 13*a*.

Torque from a drive motor 17 disposed at the back of the roll paper compartment 11 is transferred through a speed-reducing gear train 18 shown in FIG. 4 to the delivery roller 14. The roll paper 12 is supported by the delivery roller 14 and guide roller 16 as shown in FIG. 3A when the diameter of the paper roll is large, and by the delivery roller 14 and guide roller 15 when the roller diameter decreases. The roll paper 12 is thus always supported by two rollers as the roll diameter changes so that the roll can turn easily.

A head unit frame 20 is disposed horizontally at the top of the printer frame 10 above the roll paper compartment 11. A horizontal carriage guide shaft 21 is disposed to the head unit frame 20 laterally to the printer. A carriage 23 travels along the carriage guide shaft 21 bidirectionally widthwise to the printer. An inkjet head 22 is mounted on the carriage 23 with the nozzle surface facing down. The carriage 23 is driven bidirectionally widthwise to the printer by means of a carriage drive mechanism known from the literature, such as a carriage drive mechanism including a carriage motor and a timing belt.

The platen frame 24 is disposed horizontally below the inkjet head 22 in the longitudinal direction. A platen 25 is disposed to the platen frame 24 horizontally in the lateral dimension with a constant gap to the inkjet head 22. The platen 25 determines the printing position of the inkjet head 22.

A tension guide 26 is attached pivotably on the back side of the platen frame 24 (see FIG. 3B). A rear paper feed roller 27 is also disposed horizontally on the back side of the platen 25 widthwise to the printer. A rear paper pressure roller 28 that is attached on the head unit frame 20 side is pressed with predetermined force to the rear paper feed roller 27 with the printing paper 12*a* therebetween.

A front paper feed roller 29 is disposed to a position on the front side of the platen 25. A front paper pressure roller 30 that is attached on the head unit frame 20 side is pressed to the front paper feed roller 29 with the printing paper 12*a* therebetween.

The rear paper feed roller 27 and front paper feed roller 29 are driven by a paper transportation motor 31 attached to a side part 10*b* of the printer frame 10 behind the roll paper compartment 11. As indicated by dotted lines in FIG. 3A, a speed-reducing gear train 32 is disposed to the platen frame 24 in this embodiment of the invention, and torque from the paper transportation motor 31 is transferred through the speed-reducing gear train 32 to the rear paper feed roller 27 and front paper feed roller 29, which rotate synchronously.

FIG. 3B shows the tension guide 26. The tension guide 26 is disposed so that it can pivot up and down on a horizontal shaft 33 at the back end part of the platen frame 24. The tension guide 26 adjusts the tension on the printing paper 12*a* that is delivered from the roll paper 12 stored in the roll paper compartment 11 below, and has a curved guide surface 26*a* that guides the printing paper 12*a* to the platen 25. A guide pin 26*b* is disposed to the tension guide 26, a curved channel 24*a* of a constant width is formed in the platen frame 24, and the guide pin 26*b* is inserted so that it can slide inside the curved channel 24*a*. The curved channel 24*a* thus controls how far the tension guide 26 can pivot vertically, which is from a top pivot position 26A to a bottom pivot position 26B.

A torsion spring 34 disposed to the horizontal shaft 33 constantly urges the tension guide 26 in the direction pivoting up. As a result, when printing paper 12*a* is not present and the tension guide 26 is not restrained, the tension guide 26 is at the top pivot position 26A.

As shown by the bold dot-dash line in FIG. 3A, the printing paper 12*a* pulled up off the roll paper 12 in the roll paper compartment 11 curves over the tension guide 26 to the front, then passes between the rear paper feed roller 27 and rear paper pressure roller 28, between the inkjet head 22 and platen 25, and between the front paper feed roller 29 and front paper pressure roller 30, and continues to the outside through the paper exit 4. The printing paper 12*a* pushes the tension guide 26 down at this time, and the force of the torsion spring 34 thus applies a predetermined tension to the printing paper 12*a*.

The carriage 23 then travels bidirectionally while the inkjet head 22 mounted thereon prints to the part of the surface of the printing paper 12*a* that is pulled off the roll paper 12 and positioned at the printing position. After printing one line across the width of the printing paper 12*a* is finished, the rear paper feed roller 27 and front paper feed roller 29 are driven rotationally to advance the printing paper 12*a* a predetermined distance and the next line is then printed. The printing paper 12*a* is thus printed by the inkjet head 22 while being intermittently advanced a predetermined pitch. When the printing paper 12*a* is advanced intermittently, the inertia of the roll paper 12 causes the transportation load on the printing paper 12*a* to vary. This variation in the feed load is suppressed or alleviated by the tension guide 26 pivoting up and down as a result of the force from the spring. This eliminates problems caused by variation in the feed load, including a drop in paper feed precision and a drop in print quality.

A paper cutting device such as the scissors-like paper cutter 35 (not shown in FIG. 3A) having a stationary knife 35*a* and a movable knife 35*b* as shown in FIG. 4 is disposed to the paper exit 4 from which the printing paper 12*a* is discharged after printing. The paper cutter 35 cuts across the width of the printing paper 12*a* disposed between the knives.

Opening/Closing Mechanism for the Cover Unit

The opening/closing mechanism for the cover unit 3 is described next with reference to FIG. 3A and FIG. 4.

The cover unit 3 is supported on the printer case 2 by means of a 4-part parallel linkage mechanism so that the cover unit 3 can open and close. As will be known from FIG. 3A, this parallel linkage mechanism includes a pair of left and right front parallel links 41 and 42 and a pair of left and right rear parallel links 43 and 44. A front panel 45 spans laterally between the front parallel links 41 and 42, and the cover 3*a* denoted by the double-dot dash line is attached to the front panel 45. The bottom end parts of the front parallel links 41 and 42 are supported by the bottom part 10*a* of the printer frame 10 to pivot freely forward and back on a horizontal shaft 46, and the rear parallel links 43 and 44 are similarly supported by the bottom 10*a* of the printer frame 10 to pivot freely forward and back on a horizontal shaft 47.

The top end parts of the front parallel links 41 and 42 are connected freely pivotably on a horizontal shaft 49 at the front end part of the platen frame 24. The top end parts of the rear parallel links 43 and 44, however, are connected so that a specific amount of vertical movement is possible between these top ends and the back end part of the platen frame 24. In this embodiment of the invention an elongated hole 24*b* is formed in the platen frame 24, and a horizontal shaft 50 attached to the top end parts of the rear parallel links 43 and 44 is inserted pivotably and slidably in this hole 24*b*.

Figure 6:
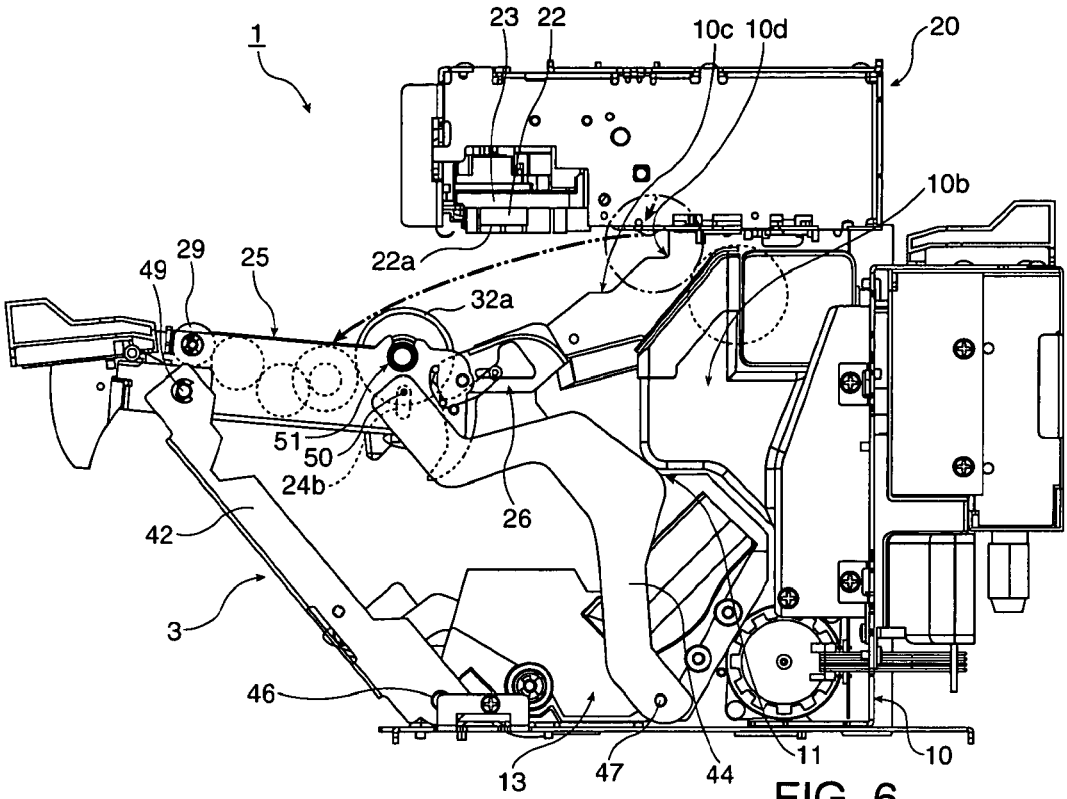
FIG. 6 is a schematic section view of the roll paper printer with the cover unit open further.

As shown in FIG. 6, an inclined positioning shoulder 10*c* that slopes upward from the front to the back is formed to a side part 10*b* of the printer frame 10 enclosing the roll paper compartment 11. The inclined positioning shoulder 10*c* is formed so that a positioning boss 51 rides onto a position in the middle of the inclined positioning shoulder 10*c*. The positioning boss 51 projects horizontally to the side from the side of the platen frame 24, and is attached to rotate freely on the platen frame 24. In this embodiment of the invention the positioning boss 51 therefore also functions as a bearing member for the rear paper feed roller 27. An inclined shoulder end face 10*d* is formed contiguously to the inclined positioning shoulder 10*c*. When the positioning boss 51 is positioned to the inclined shoulder end face 10*d*, the platen 25 is set to the printing position opposite the inkjet head 22.

When the cover unit 3 is closed, the positioning boss 51 rides onto the inclined positioning shoulder 10*c* and is positioned against the inclined shoulder end face 10*d*, thus holding the platen frame 24 substantially horizontally and holding the platen 25 attached to the platen frame 24 opposite the nozzle surface of the inkjet head 22 with a predetermined gap therebetween.

When the cover unit 3 opens and closes, the platen 25, the tension guide 26, the rear paper feed roller 27, the front paper feed roller 29, the speed-reducing gear train 32, and other parts mounted on the platen frame 24 also open and close. Therefore, when the cover unit 3 opens, the paper transportation path from the roll paper compartment 11 to the paper exit 4 also opens.

Opening and Closing the Cover Unit 3

Figure 5:
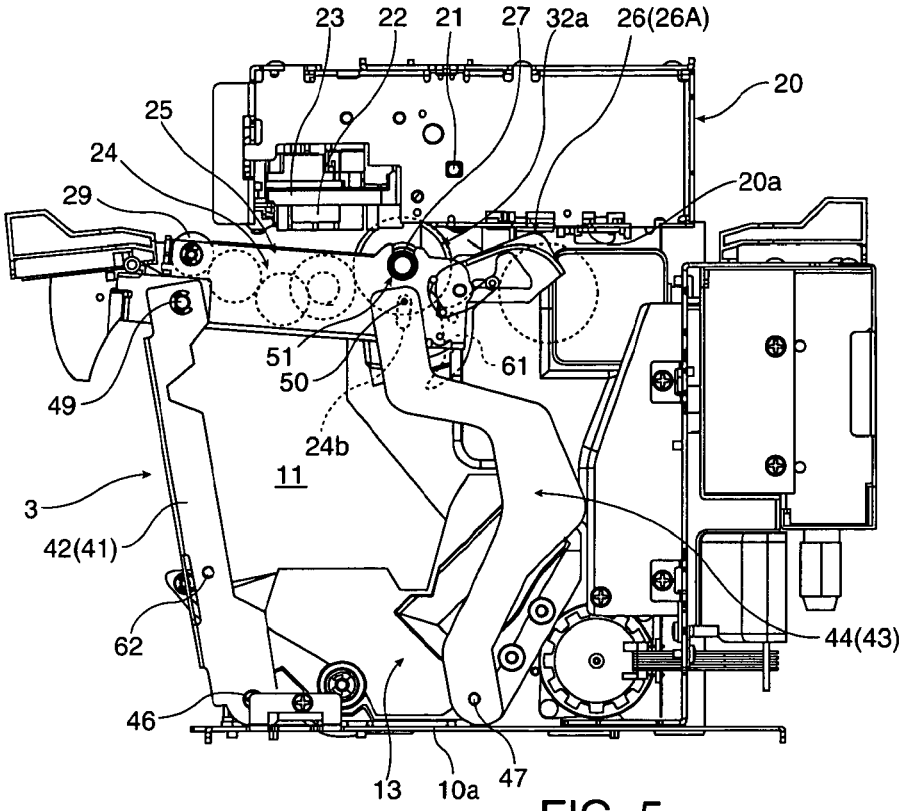
FIG. 5 is a schematic section view of the roll paper printer with the cover unit slightly open.
Figure 7B:
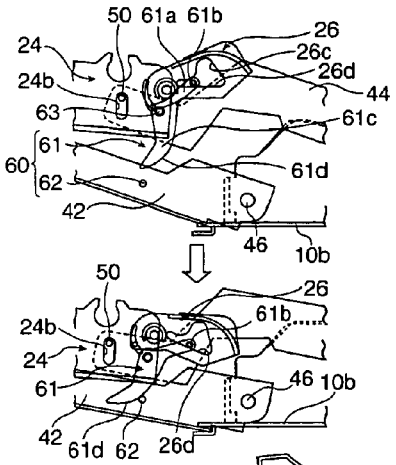
FIG. 7B describes the tension guide retraction mechanism.

FIG. 5 is a side view of the cover unit 3 when slightly open, and FIG. 6 is a side view when the cover unit 3 is open somewhat more. FIG. 7 is a side view when the cover unit 3 is open all the way, and FIG. 7B describes the action of the tension guide 26. The movement of selected parts when the cover unit 3 opens and closes is described next with reference to FIG. 3 to FIG. 7.

When the cover unit 3 is in the locked and closed vertical position shown in FIG. 3A and FIG. 4, the lock is released, and the cover unit 3 is pulled forward to open, the cover unit 3 pivots forward on the horizontal shaft 46 between the front parallel links 41 and 42. The platen frame 24, which bridges between the front parallel links 41 and 42 and the rear parallel links 43 and 44, also moves forward and down. This movement causes the positioning boss 51 of the platen frame 24 to separate from the inclined shoulder end face 10*d* and slide down along the inclined positioning shoulder 10*c* while the weight of the platen frame 24 causes the back end of the platen frame 24 to drop as far as permitted by the hole 24*b* to a position sloped to the back.

The gears 32*a* of the speed-reducing gear train 32 and the tension guide 26 are disposed to the platen frame 24 as protruding members that project vertically above the platen 25. When not suppressed by the printing paper 12*a*, the tension guide 26 is urged upward by the force of the spring and contacts the bottom 20*a* of the head unit frame 20. If the back end of the platen frame 24 does not descend, the gears 32*a* and tension guide 26 will interfere with the inkjet head 22 when the cover unit 3 opens. In this embodiment of the invention the back end of the platen frame 24 descends so that the platen frame 24 slopes down to the back, however, and the gears 32*a* and tension guide 26 therefore do not interfere with parts of the inkjet head 22. As shown in FIG. 6, for example, the top of the gears 32*a* follows a path denoted by the double-dot dash line, and thus moves without interfering with the nozzle surface 22*a* of the inkjet head 22.

Figure 7A:
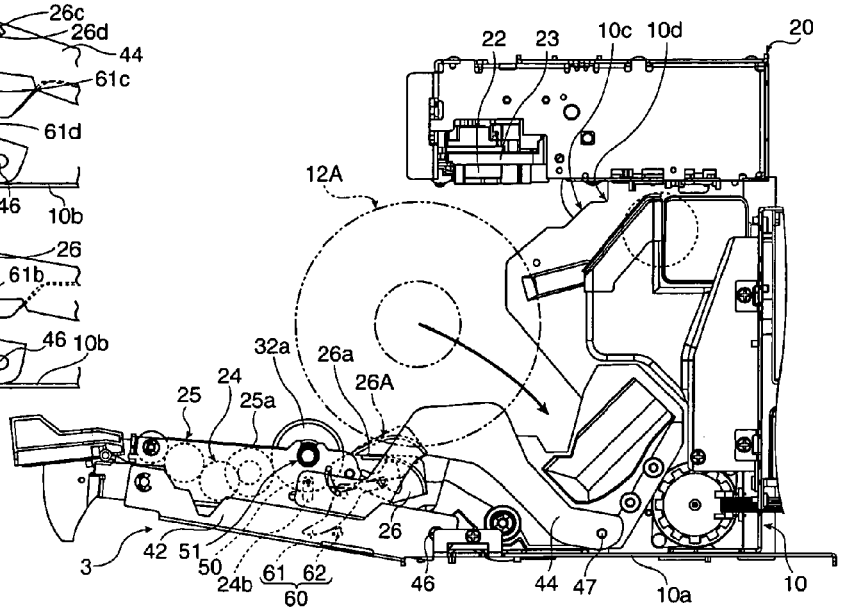
FIG. 7A is a schematic section view of the roll paper printer with the cover unit completely open.

As described above, when the cover unit 3 opens, the cover unit 3 can be opened forward to a substantially horizontal open position as shown in FIG. 7A without the parts on the platen frame 24 interfering with parts on the inkjet head 22 side. In this open position the front parallel links, the platen frame, and the rear parallel links fold together to the cover 3*a* in a substantially horizontal position.

When the cover unit 3 is in the open position shown in FIG. 7A and is then closed, the action described above is reversed. In this case the platen frame 24 remains inclined with the back end thereof down while the platen frame 24 closes in conjunction with the cover 3*a*. The parts mounted on the platen frame 24 therefore move to the closed position without interfering with parts on the inkjet head 22 side.

Before the cover unit 3 reaches the closed position, the positioning boss 51 on the platen frame 24 rides onto and along the inclined positioning shoulder 10*c* disposed to the side part 10*b* of the printer frame 10. As the cover unit 3 moves to the closed position, the positioning boss 51 rises while sliding along the inclined positioning shoulder 10*c*, thereby lifting the back end of the platen frame 24 to the horizontal position as the positioning boss 51 travels to the end face 10*d*. The positioning boss 51 thus stops against the end face 10*d* formed contiguously to the inclined positioning shoulder 10*c*, and the platen frame 24 is positioned substantially horizontally.

As a result, as shown in FIG. 3A and FIG. 4, the platen 25 is held opposite the inkjet head 22 with a predetermined gap therebetween, and is positioned to the printing position.

When the cover unit 3 is opened in this embodiment of the invention, the tension guide 26 is unconditionally escaped to the cover 3*a* side to a position at substantially the same height as the surface 25*a* of the platen 25. More specifically, the tension guide 26 is urged upward by the torsion spring 34. Therefore, when the cover unit 3 is opened and the tension guide 26 is folded to the side of the cover 3*a*, the tension guide 26 remains at the top pivot position 26A to which it is pushed by the spring and thus protrudes above the surface 25*a* of the platen 25. When the tension guide 26 is thus pushed up, the tension guide 26 interferes with inserting a new paper roll 12A as indicated by the double-dot dash line in FIG. 7A. This embodiment of the invention therefore has a retraction mechanism that retracts the tension guide 26 to the cover 3*a* side, and when the cover unit 3 is opened to the open position as shown FIG. 7A, the tension guide 26 is retracted to a position at substantially the same height as the surface 25*a* of the platen 25 that is folded to the side of the cover 3*a*.

Referring to FIG. 7B, the retraction mechanism 60 includes an engagement lever 61 attached on the platen frame 24 side, and a catch pin 62 disposed to the front parallel link 42. The engagement lever 61 is disposed so that it can pivot up and down on a horizontal pin 63. A cam pin 61*b* is disposed to the leading end of the arm 61*a* that extends upward from the horizontal pin 63 of the engagement lever 61. This cam pin 61*b* engages the cam face 26*d* of an opening 26*c* formed in the tension guide 26, and can slide along this cam face 26*d*. Another arm 61*c* extends downward from the horizontal pin 63 of the engagement lever 61, and a convexly curved guide surface 61*d* is formed on the edge on the back side of the arm 61*c*.

The catch pin 62 is disposed to the front parallel link 42 where the 62 can engage the guide surface 61*d* of the bottom arm 61*c* of the engagement lever 61. More specifically, when the cover unit 3 is tilted forward to the open position, the platen frame 24 folds together to the front parallel link 42, and the guide surface 61*d* of the engagement lever 61 on the platen frame 24 side contacts the catch pin 62 on the front parallel link 42 side. Thereafter until the cover unit 3 reaches the open position, the engagement lever 61 pivots while being pushed by the catch pin 62. When the engagement lever 61 rotates, the tension guide 26 is rotated downward in the opposite direction as the urging force of the torsion spring 34.

As a result, when the cover unit 3 pivots to the open position, the tension guide 26 is retracted to the cover 3*a* side to a position at substantially the same height as the surface 25*a* of the platen 25. The tension guide 26 therefore does not interfere with inserting a paper roll 12A, and the roll paper can be easily inserted as shown in FIG. 7A.

EFFECT OF THE INVENTION

As described above, when a cover unit 3 that opens and closes is opened and closed by a 4-part parallel linkage mechanism in a roll paper printer 1 according to this invention, the platen frame 24 rendering the parallel linkage mechanism moves to an inclined position with the back end down. The speed-reducing gear train 32 and tension guide 26 that are mounted on the platen frame 24 and protrude above the platen 25 are thus prevented from contacting and damaging any parts on the inkjet head 22 side.

Parts that protrude beyond the platen 25 towards the inkjet head 22 can thus be mounted on the platen frame 24. Damage to the inkjet head 22 is also prevented even if the cover unit 3 opens and closes without the inkjet head 22 moved to a retracted position outside of the printing area. It is therefore not necessary to confirm whether the inkjet head 22 has moved to the retracted position before opening and closing the cover unit 3.

The inkjet head 22 will also not be damaged even if the cover unit 3 is opened accidentally while the inkjet head 22 is in the printing area. Damage to the inkjet head 22 as a result of forgetting to lock the cover unit 3 is therefore also prevented.

The invention has been described using a roll paper printer with an inkjet head byway of example, but the invention is not so limited and can also be applied to a roll paper printer with a thermal head. The invention can also be applied to a roll paper line printer. The invention can also be applied to printers other than roll paper printers.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A printer comprising:

a print head mounted on a printer frame;

a cover that opens and closes;

a platen that is disposed in a printing position opposite the print head when the cover is closed;

a linkage mechanism having a front link and a rear link, each of the front link and the rear link being pivotably supported on the printer frame;

a platen frame that connects the front link and the rear link and supports the platen; and a positioning member configured to contact the platen frame and to position the platen in the printing position;

wherein the platen frame and the rear link are connected by an elongated hole formed in either one of the platen frame and the rear link so that the platen can move from the printing position to an inclined position where a rear end of the platen has moved down a predetermined distance relative to the printing position when the cover opens.

2. The printer described in claim 1, wherein:

the positioning member is an inclined shoulder formed on the printer frame;

a positioning boss is disposed on the platen frame at a position opposing the inclined shoulder; and when the cover is closed, the positioning boss moves along the inclined shoulder and is positioned to the printing position.

3. The printer described in claim 1, wherein:

the print head is an inkjet head; and the printing position of the platen is a position opposing a nozzle surface of the inkjet head with a predetermined gap therebetween.

4. The printer described in claim 1, wherein:

contact between the platen frame and the positioning member is released when the cover is opened.

5. The printer described in claim 1, wherein:

the predetermined distance is a length of the elongated hole.

* * * * *